US009669322B2

(12) United States Patent
Nagai

(10) Patent No.: US 9,669,322 B2
(45) Date of Patent: Jun. 6, 2017

(54) TOY TOP

(71) Applicant: TOMY COMPANY, LTD., Tokyo (JP)

(72) Inventor: Tomohito Nagai, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 14/903,185

(22) PCT Filed: Apr. 15, 2014

(86) PCT No.: PCT/JP2014/060737
§ 371 (c)(1),
(2) Date: Jan. 6, 2016

(87) PCT Pub. No.: WO2015/159368
PCT Pub. Date: Oct. 22, 2015

(65) Prior Publication Data
US 2016/0151716 A1 Jun. 2, 2016

(51) Int. Cl.
*A63H 1/00* (2006.01)
*A63H 17/00* (2006.01)
(Continued)

(52) U.S. Cl.
CPC ..... *A63H 1/00* (2013.01); *A63H 1/06* (2013.01); *A63H 17/004* (2013.01); *A63H 29/22* (2013.01);
(Continued)

(58) Field of Classification Search
CPC ..... A63H 1/00; A63H 17/00; A63H 17/004; A63H 17/26; A63H 31/00; A63H 31/08; A63H 29/00; A63H 29/22; A63H 33/005
See application file for complete search history.

(56) References Cited

U.S. PATENT DOCUMENTS 3,512,300 A * 5/1970 Thoresen ..... A63H 11/10 446/289
4,306,329 A * 12/1981 Yokoi ..... A47L 11/4011 15/319
(Continued)

FOREIGN PATENT DOCUMENTS

JP 54-114344 9/1979
JP 61-11084 1/1986
(Continued)

OTHER PUBLICATIONS

Office Action mailed Mar. 3, 2015 in Japanese Patent Application No. 2014-522254.
(Continued)

*Primary Examiner* — Gene Kim
*Assistant Examiner* — Alyssa Hylinski
(74) *Attorney, Agent, or Firm* — Staas & Halsey LLP

(57) ABSTRACT

A toy top equipped with a motor having a battery as a power source, wherein a main body is furnished with: a first wheel and a second wheel provided a specified distance from each other in a wheel axis direction; and a motive power transmission mechanism, for transmitting motive power from the motor and for rotating the first wheel in a first direction while rotating the second wheel in a second different direction The toy top is stable with respect to external forces and with which a range of top games can be broadened.

15 Claims, 9 Drawing Sheets

(51) Int. Cl.

| | |
|---|---|
| ***A63H 31/00*** | (2006.01) |
| ***A63H 29/22*** | (2006.01) |
| ***A63H 33/00*** | (2006.01) |
| ***A63H 30/02*** | (2006.01) |
| ***A63H 1/06*** | (2006.01) |

(52) U.S. Cl.
CPC ..... *A63H 30/02* (2013.01); *A63H 31/00* (2013.01); *A63H 33/005* (2013.01)

(56) References Cited

U.S. PATENT DOCUMENTS

| | | | | | |
|---|---|---|---|---|---|
| 4,346,893 | A * | 8/1982 | Landsinger | A63H 13/04 | 273/108.4 |
| 4,623,320 | A * | 11/1986 | Kakizaki | A63H 30/04 | 446/290 |
| 4,717,364 | A * | 1/1988 | Furukawa | A63H 11/00 | 367/198 |
| 5,020,798 | A * | 6/1991 | Yang | A63H 1/04 | 273/440 |
| 5,273,480 | A | 12/1993 | Suto | | |
| 5,335,917 | A * | 8/1994 | Kuna | A63F 9/30 | 273/445 |
| 5,699,869 | A * | 12/1997 | Fritzinger | A63H 31/00 | 180/65.51 |
| 5,823,845 | A | 10/1998 | O'Berrigan | | |
| 5,871,386 | A * | 2/1999 | Bart | A63H 15/06 | 446/443 |
| 6,530,817 | B1 * | 3/2003 | Winslow | A63H 1/00 | 446/256 |
| 8,298,039 | B2 * | 10/2012 | Liu | A63H 17/262 | 446/431 |
| 2007/0205554 | A1 * | 9/2007 | Elliott | A63F 9/16 | 273/126 R |
| 2010/0297909 | A1 * | 11/2010 | Su | A63H 29/22 | 446/465 |
| 2011/0056759 | A1 * | 3/2011 | Chiu | A47L 9/009 | 180/218 |

FOREIGN PATENT DOCUMENTS

| | | |
|---|---|---|
| JP | 5-329273 | 12/1993 |
| JP | 3020661 | 11/1995 |
| JP | 9-44249 | 2/1997 |
| JP | 2000-218578 | 8/2000 |
| JP | 2002-119770 | 4/2002 |
| JP | 2005-27985 | 2/2005 |
| JP | 2008-158868 | 7/2008 |

OTHER PUBLICATIONS

International Search Report mailed Jul. 15, 2014 in International Patent Application No. PCT/JP2014/060737.

International Preliminary Report on Patentability dated Oct. 18, 2016 in corresponding International Patent Application No. PCT/JP2014/060737.

* cited by examiner

TOY TOP

CROSS-REFERENCE TO RELATED APPLICATIONS

This application is a National Stage application under 35 U.S.C. Section 371 of PCT International Application No. PCT/JP2014/060737, filed Apr. 15, 2014, the contents of which are incorporated herein by reference.

TECHNICAL FIELD

The present invention relates to a toy top.

BACKGROUND ART

A toy top that includes a motor to rotate a spinning shaft is disclosed in, for example, Patent Document 1 as an electric toy top.

PRIOR ART DOCUMENT

Patent Document 1: JP S54-114344 A

In the electric toy top described in Patent Document 1, since the toy top is supported by a single spinning shaft, the position may become too unstable when it is subjected to an external force.

Another problem is that, the toy top cannot be started from a state of being placed on a floor, since the standing position cannot be maintained at a low spinning speed.

SUMMARY OF INVENTION

It is an object of the present invention to provide a toy top that is relatively stable against external forces, can be started from a state of being placed on a floor, and that can therefore widen the ways to play with toy tops.

The invention can include a toy top having a battery and a motor powered by the battery, wherein a main body includes:

a first wheel and a second wheel that are disposed at a predetermined distance from each other along a wheel axis; and a power transmission mechanism that is capable of transmitting a power of the motor to rotate the first wheel in a first direction and to rotate the second wheel in a second direction that is different from the first direction.

The invention can include a toy top according to the above, wherein the motor is a reversible motor.

The invention can include a toy top according to the above, wherein the power transmission mechanism is configured such that when the motor rotates in a forward direction, the first wheel rotates in the first direction and the second wheel rotates in the second direction, and when the motor rotates in a reverse direction, the first wheel rotates in the first direction and the second wheel is disconnected from power transmission.

The invention can include a toy top according to the above, wherein the main body further includes a lock that locks rotation of the second wheel when the motor rotates in the reverse direction.

The invention can include a toy top according to the above, wherein the power transmission mechanism includes:

a sun gear coupled to the motor;

a first planetary gear and a second planetary gear that are engaged with the sun gear;

a first gear train coupled to the first wheel; and a second gear train coupled to the second wheel, wherein when the motor rotates in the forward direction, the first planetary gear is coupled to the first wheel through an even or odd number of first power transmission gear in the first gear train, and the second planetary gear is coupled to the second wheel through a specified number of second power transmission gear in the second gear, in which the specified number has a same parity as the number of the first transmission gear, and wherein when the motor rotates in the reverse direction, the second planetary gear is coupled to the first wheel through a specified number of third power transmission gear in the first gear train, and the first planetary gear is not engaged with any gear in the second gear train, in which the specified number has different parity from the number of the first transmission gear.

The "same parity" means that if one is an even number, then the other is also an even number. If one is an odd number, then the other is also an odd number. The "different parity" means that if one is an even number, then the other is an odd number. If one is an odd number, then the other is an even number.

The invention can include a toy top according to the above, wherein the first planetary gear and the second planetary gear are supported by an arm that swings about an axis of the sun gear, and wherein the lock mechanism includes a part to be locked that is integrally formed with one of gears in the second gear train, and a locking part that is disposed in the arm and that locks the part to be locked when the motor rotates in the reverse direction so as to lock rotation of the second wheel.

With the above, the top body does not have a spinning shaft (axis rod) but spins by means of a pair of wheels. Therefore, novel and innovative toy tops can be achieved. Further, since the top body stands on the pair of wheels, the spinning position is relatively stable. This is particularly advantageous during startup or the like when the spinning speed is low. Further, the toy top is driven by the motor. Therefore, toy tops that can stably spin for a long time can be achieved. In this case, inexpensive toy tops can be achieved by using only a single motor.

With the above, not only does the pair of wheels rotate in mutually opposite directions, but also the rotational direction of the motor can be reversed. This enables the toy top to perform a variety of motions. Therefore, toy tops that perform novel motions can be achieved.

With the above, not only does the pair of wheels rotate in mutually opposite directions, but also the rotational direction of the motor can be reversed so that one of the wheels is disconnected from power transmission. This can make the toy top perform different motions. Therefore, toy tops that perform novel motions can be achieved.

With the above, the rotation of the second wheel is locked when the motor rotates in the reverse direction. This makes the motion of the toy top unstable compared to the state in which the pair of wheels rotates in mutually opposite directions. Accordingly, depending on the conditions of the floor on which the toy top is placed when playing, the spinning speed of the toy top and the like, the toy top performs a variety of amusing motions, such as a circulating motion. For battle toy tops for example, such motions are effective in order to dodge an attack. In particular, when the toy top transits from the state in which the pair of wheels rotates in mutually opposite directions to the state in which the rotation of one of the wheels is locked, it is possible to enjoy a more drastic change of behavior.

DETAILED DESCRIPTION

Hereinafter, a toy top according to embodiments of the present invention will be described.

OVERALL

1. Configuration

Figure 1:
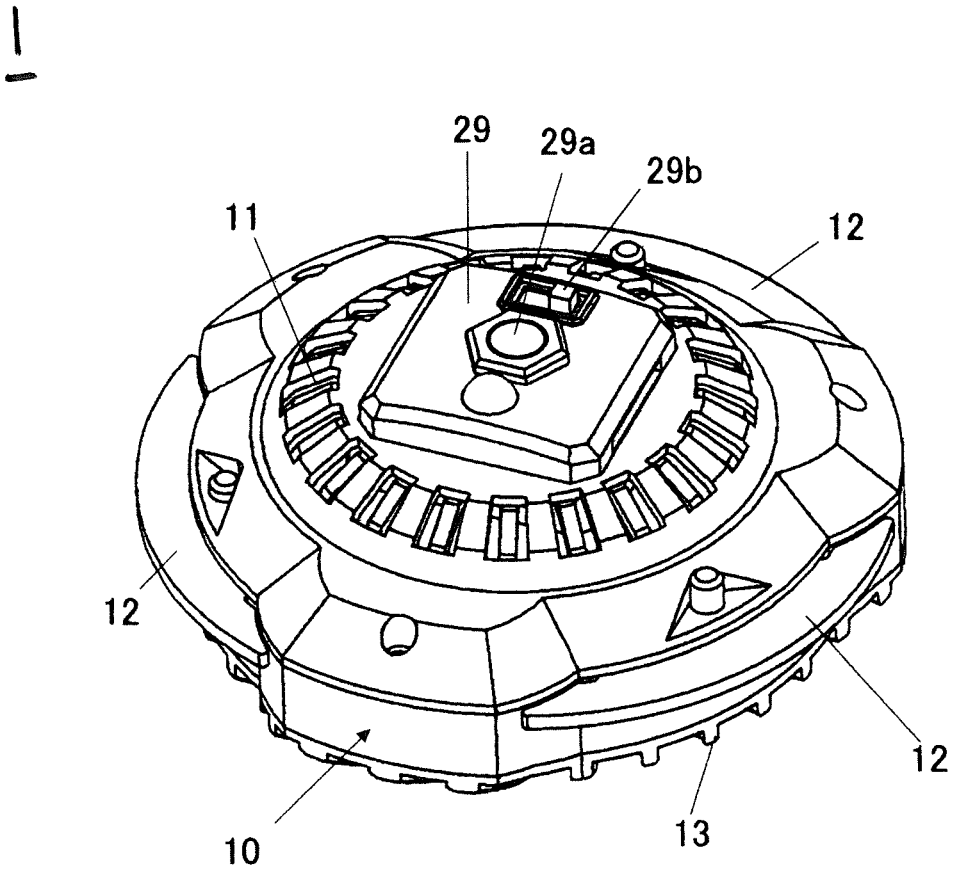
FIG. 1 is a perspective view of a toy top according to an embodiment of the present invention, illustrating the outer appearance thereof.
Figure 2:
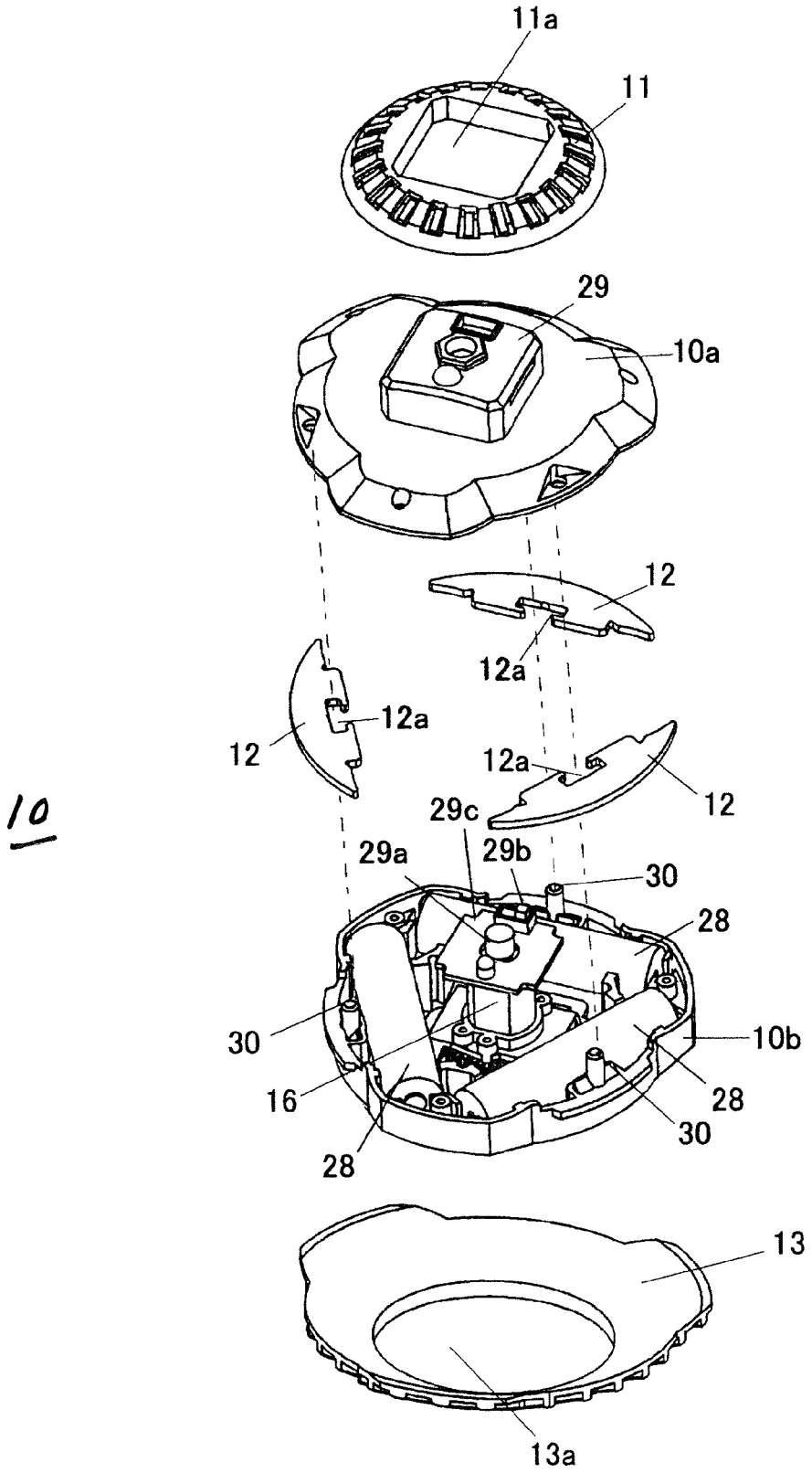
FIG. 2 is an exploded perspective view of the toy top according to the embodiment.

FIG. 1 is a perspective view of a toy top according to an embodiment of the present invention, illustrating the outer appearance thereof, and FIG. 2 is an exploded perspective view of the toy top.

The toy top 1 roughly includes a main body 10, an upper deck 11 disposed over the main body 10, side plates 12 protruding outward from the sides of the main body 10, and a bottom plate 13 disposed on the bottom of the main body 10. The main body 10 may instead not be provided with the upper deck 11, the side plates 12 or the bottom plate 13.

As illustrated in FIG. 2, the main body 10 includes a main body upper portion 10*a* and a main body lower portion 10*b*. Inside the main body 10, a motor 16 and batteries 28 are provided. Further, in the lower part of the main body 10, a pair of wheels 14*a*, 14*b* (see FIG. 8) is provided. Further, in the main body 10, a photosensor 29*a* and a power switch 29*b* are provided.

2. Outline of Action

When the power switch 29*b* of the toy top 1 is turned on and then a hand is held over the toy top 1 such that the hand passes over the toy top 1 once, the toy top 1 spins in the same location. When a hand is held over the toy top 1 such that the hand passes over the toy top 1 twice in a predetermined short time, the toy top spins and performs a variety of actions such as a large circling action. When a hand is held over the toy top 1 for a long time, the toy top 1 stops the action, although it is not particularly limited thereto.

Hereinafter, details of the toy top 1 will be described.

DETAILS

1. Configuration of Main Body 10

Figure 3:
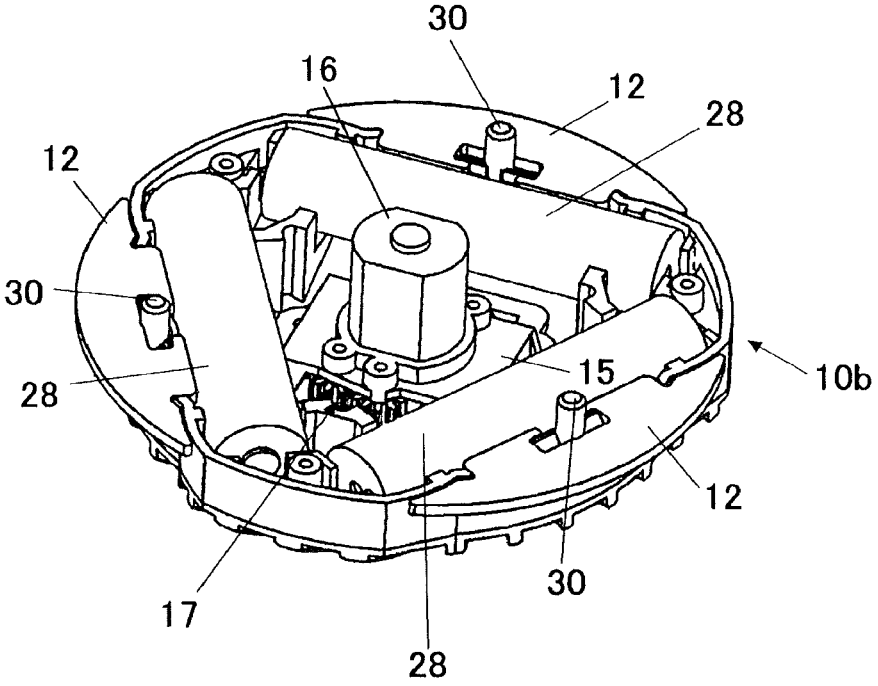
FIG. 3 is a perspective view of a main body lower portion of the toy top according to the embodiment, illustrating the inside of the main body.
Figure 8:
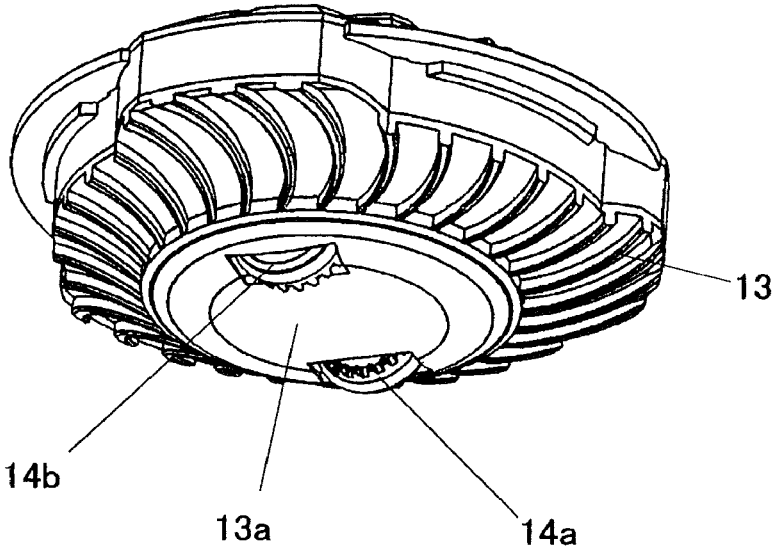
FIG. 8 is a perspective view of the toy top according to the embodiment from below.

As illustrated in FIG. 3, the main body lower portion 10*b* has a bowl shape. As illustrated in FIG. 8, the main body lower portion 10*b* rotatably supports the wheels 14*a*, 14*b* at the left and right sides across the center axis.

A frame 15 is disposed between the left and right wheels 14*a*, 14*b*, and a reversible motor 16 is disposed therein. The reversible motor 16 is attached in the frame 15 such that the shaft thereof extends in the vertical direction and protrudes downward. Further, the main part of a power transmission mechanism 17 is mounted in the frame 15, which is capable of coupling the reversible motor 16 with the left and right wheels 14*a*, 14*b*.

In the main body lower portion 10*b*, three AAA batteries 28 are disposed, but they are not particularly limited thereto. The three batteries 28 are disposed surrounding the frame 15 from three directions. The three batteries 28 are electrically connected in series when they are disposed in the main body lower portion 10*b*.

The toy top 1 also includes a controller 29*c* that controls the motor 16. The controller 29*c* is housed in a control box 29 disposed in the upper part of the toy top 1. The controller 29*c* is constituted by a programmable logic circuit or a wired logic circuit.

On the upper surface of the control box 29, the photosensor 29*a* is disposed. The photosensor 29*a* detects the manner of a hand gesture, and the controller 29*c* controls the motor 16 based on the detection result. For example, when a hand is held over the toy top 1 such that the hand passes over the toy top 1 once, the controller 29*c* makes the toy top 1 spin in the same place by controlling the rotation of the motor 16. When a hand is held over the toy top 1 such that the hand passes over the toy top 1 twice in a predetermined short time T1, the controller 29*c* makes the toy top 1 perform a variety of actions such as a large circling action by controlling the rotation of the motor 16. When a hand is held over the toy top 1 for a long time, the controller 29*c* makes the toy top 1 stop the action by controlling the rotation of the motor 16. When another hand gesture is performed while the toy top 1 is spinning according to a certain hand gesture, the controller 29*c* switches the action of the toy top 1.

The controlling manner of the controller 29*c* is not limited thereto. For example, while the toy top 1 is spinning at the same place after a hand is held over the toy top 1 once, when a hand is held over the toy top 1 once again for a time period longer than the time T1, the controller 29*c* may increase the spinning speed of the toy top 1 by controlling the rotation of the motor 16.

2. Power Transmission Mechanism

Next, the power transmission mechanism 17 will be described based on FIG. 4 through FIG. 7.

A pinion 21 is fixed to a shaft 16*a* of the motor 16. The pinion 21 serves as a sun gear of a planetary gear mechanism. The pinion 21 is engaged with a gear 20*a* and a gear 20*b*. The gear 20*a* and the gear 20*b* are disposed sandwiching the pinion 21. The gear 20*a* and the gear 20*b* serve as planetary gears of the planetary gear mechanism. The gear

20*a* and the gear 20*b* are supported about respective axes by an arm 18 that is swingable about the shaft 16*a* of the motor 16. Specifically, the arm 18 is swingably supported at the center part thereof by the shaft 16*a* of the motor 16, the gear 20*a* is supported at one end of the arm 18 by a shaft 19*a*, and the gear 20*b* is supported at the other end of the arm 18 by a shaft 19*b*.

In the wheel 14*a*, which is one of the wheels, a crown gear 23*a* is provided. The crown gear 23*a* is engaged with a gear 24*a*. Further, the gear 24*a* is engaged with a gear 25*a*. The crown gear 23*a* and the gears 24*a*, 25*a* constitute a second gear train. In the gear 24*a*, a part to be locked 27*b* with three hooks is integrally provided.

In the right wheel 14*b*, a crown gear 23*b* is provided. The crown gear 23*b* is engaged with a gear 24*b*. Further, the gear 24*b* is engaged with a gear 25*b*. The crown gear 23*b* and the gears 24*b*, 25*b* constitute a first gear train.

Figure 6A:
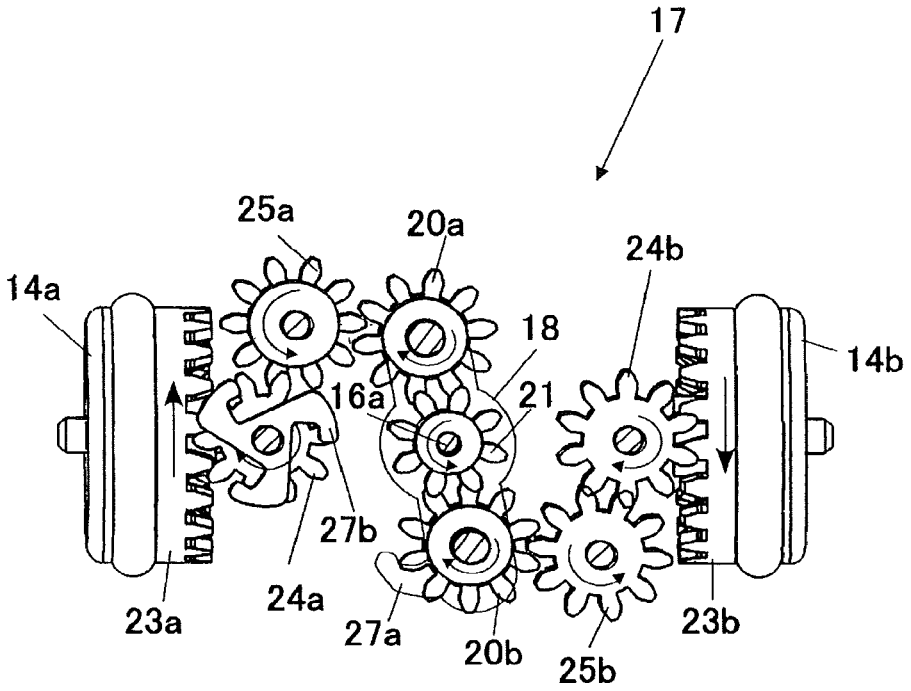
FIG. 6A is a plan view illustrating an operation of the power transmission mechanism.

In the power transmission mechanism 17, for example, when the pinion 21 rotates in the anti-clockwise direction as illustrated in FIG. 6A, the arm 18 swings in the anti-clockwise direction due to rotation of the gears 20*a*, 20*b*. As a result of the swing of the arm 18 in the anti-clockwise direction, the gear 20*a* engages with the gear 25*a*, and the gear 20*b* engages with the gear 25*b*. Accordingly, the rotation of the pinion 21 of the motor 16 is transmitted to the crown gear 23*a* through the gears 20*a*, 25*a*, 24*a* so that the wheel 14*a* rotates in the arrow direction. Also, the rotation of the pinion 21 of the motor 16 is transmitted to the crown gear 23*b* through the gears 20*b*, 25*b*, 24*b* so that the wheel 14*b* rotates in the arrow direction.

Figure 6B:
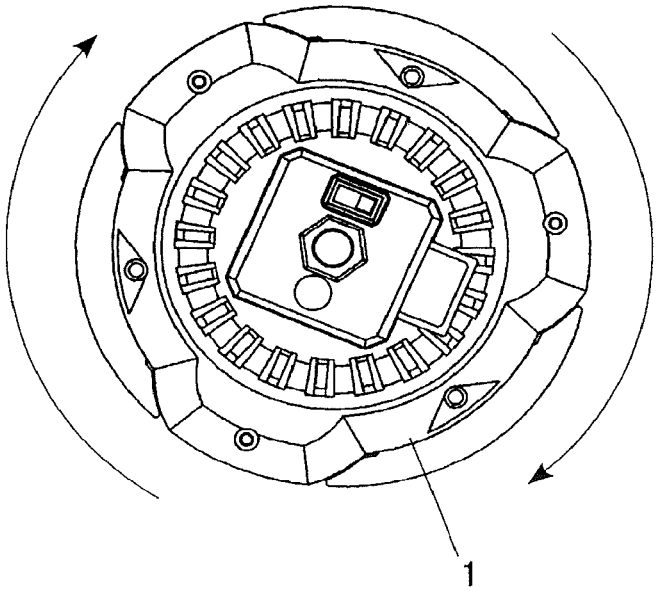
FIG. 6B is a plan view of the toy top illustrating the behavior thereof when the power transmission mechanism operates as illustrated in FIG. 6A.

As a result, the wheels 14*a*, 14*b* rotate in mutually opposite directions. Therefore, the toy top 1 spins in the same place as illustrated in FIG. 6B.

Figure 4:
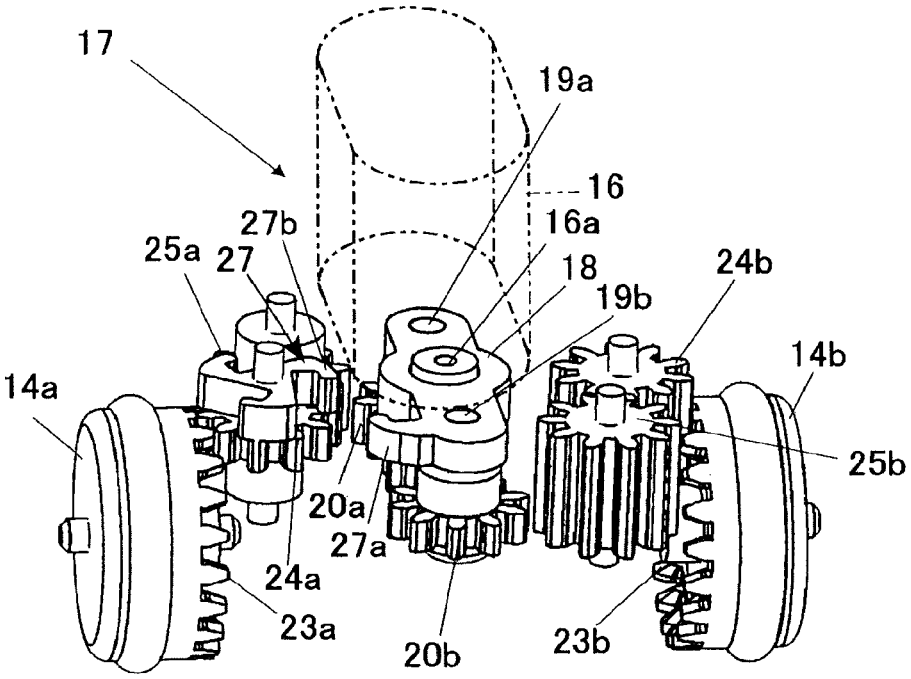
FIG. 4 is a perspective view of a power transmission mechanism of the toy top according to the embodiment.
Figure 5:
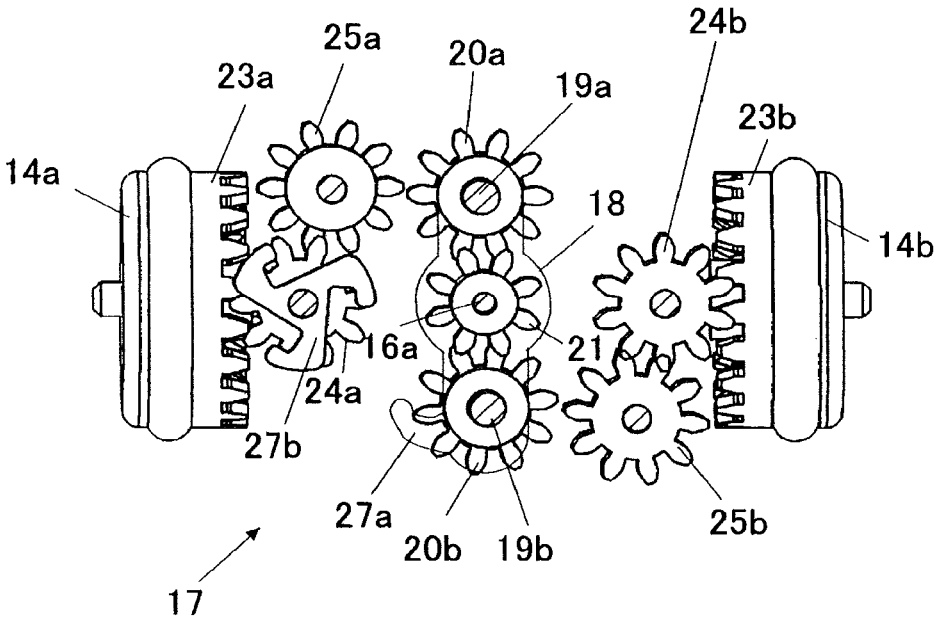
FIG. 5 is a plan view of the power transmission mechanism of the toy top according to the embodiment.

The power transmission mechanism 17 also has a clutch mechanism. The clutch mechanism disconnects the power transmission to the wheel 14*a* when the pinion 21 rotates in the opposite direction (clockwise direction). For this configuration, in the toy top 1 according to the embodiment, the gear 20*b* of the arm 18 and the gear 24*a* are offset from each other in the vertical direction as illustrated in FIG. 4.

Figure 7A:
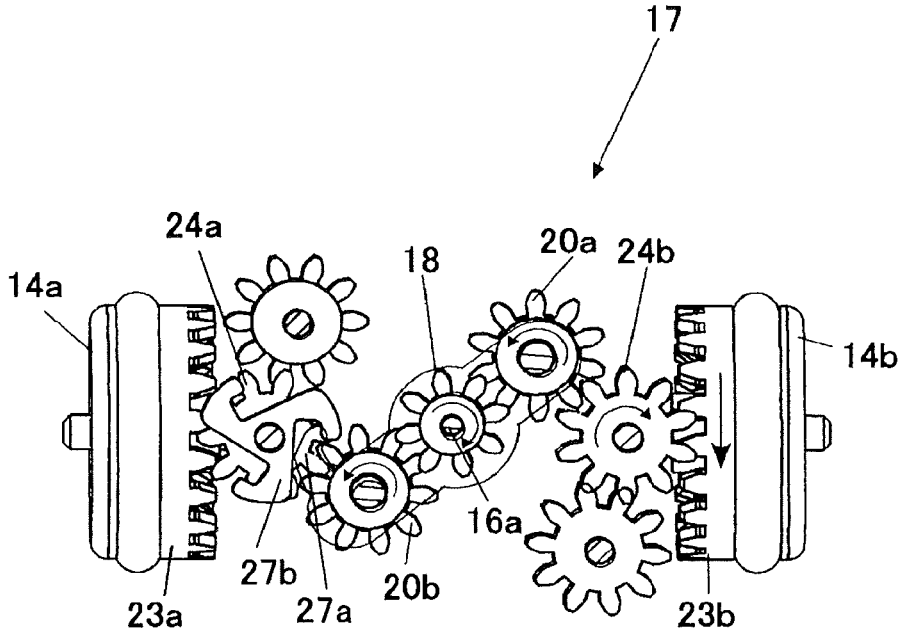
FIG. 7A is a plan view illustrating another operation of the power transmission mechanism.

The operation of the clutch mechanism will be described. As illustrated in FIG. 7A, when the pinion 21 rotates in the clockwise direction, the arm 18 swings in the clockwise direction, and the gear 20*a* engages with the gear 24*b*. The gear 24*b* transmits the rotation of the pinion 21 to the wheel 14*b*, so that the wheel 14*b* rotates in the arrow direction. While the rotation of the pinion 21 is transmitted to the gear 20*b*, it is not transmitted from the gear 20*b* to the gear 24*b* since the gear 20*b* and the gear 24*b* do not engage with each other. Accordingly, the wheel 14*a* is released.

The power transmission mechanism 17 also has a brake (lock) mechanism. The brake mechanism 27 regulates the rotation of only one of the pair of wheels 14*a*, 14*b* (wheel 14*a* in the embodiment). As illustrated in FIG. 4, the brake mechanism 27 includes a locking part 27*a* disposed at the tip of the arm 18 and a part to be locked 27*b* disposed coaxially and integrally with the gear 24*a*.

The brake (lock) mechanism is not necessarily provided.

In the brake mechanism, as illustrated in FIG. 7A, when the pinion 21 rotates in the clockwise direction and the arm 18 thereby swings in the clockwise direction, the locking part 27*a* of the arm 18 engages with (comes in contact with) the part to be locked 27*b* that is integrally formed with the gear 24*a*. That is, although the power transmission from the motor 16 has been disconnected, the wheel 14*a* rotates by being driven by the running wheel 14*b*, and the part to be locked 27*b* thereby engages with the locking part 27*a* of the arm 18. As a result, the rotation of the gear 24*a* is locked, and the rotation of the wheel 14*a* is locked accordingly.

Figure 7B:
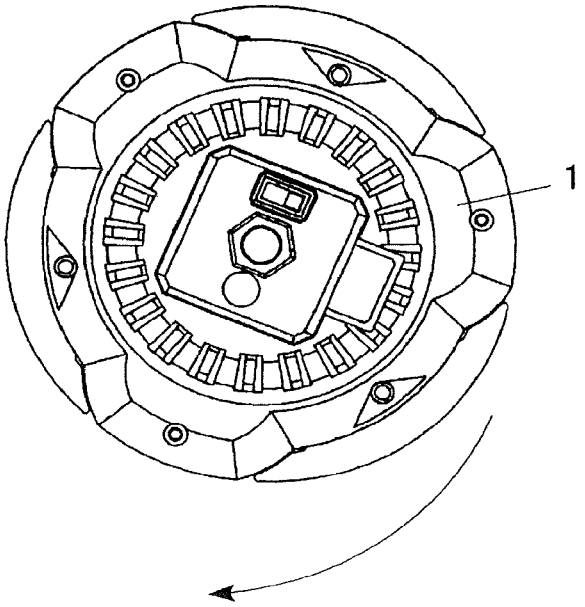
FIG. 7B is a plan view of the toy top illustrating the behavior thereof when the power transmission mechanism operates as illustrated in FIG. 7A.

In this way, while the wheel 14*b* rotates, the rotation of the wheel 14*a* is locked. As a result, for example, the toy top 1 makes a large circle about the wheel 14*a* as illustrated in FIG. 7B.

3. Wheels 14*a*, 14*b*

Among the pair of wheels 14*a*, 14*b*, the free rotatable wheel 14*b* may be made of a highly frictional material such as rubber in order to increase the grip performance against a ground surface such as a floor. Alternatively, a rubber ring or the like may be fitted around the periphery of the wheel 14*b*. The locked non-rotatable wheel 14*a* has low friction compared to the wheel 14*b*. In principle, the motion of the toy top 1 becomes larger as the gripping performance of the wheel 14*a* is increased, but this also increases the load on the motor 16 and therefore decreases the rotation speed. The above configuration is determined considering the balance between the gripping performance and the rotation speed. When it is not necessary to consider the balance, it is needless to say that the gripping performance of the wheel 14*a* may be increased.

4. Upper Deck 11

The upper deck 11 of the toy top 1 also serves to change the position of the center of gravity of the toy top 1. By replacing the upper deck 11 with another one with a different weight, the position of the center of gravity of the toy top 1 can be changed in the vertical direction. Further, the upper deck 11 may also serve as a flywheel.

As illustrated in FIG. 2, the upper deck 11 is formed in a disk shape and has a rectangular hole 11*a* in the center. The control box 29 disposed in the upper part of the main body upper portion 10*a* is fitted in the hole 11*a* so that the upper deck 11 is supported.

5. Side Plates 12

The side plates 12 are weapons for fighting the other toy top 1. A variety of side plates 12 with different outer shapes are prepared, and a suitable set is selected and attached to the main body 10. As illustrated in FIG. 2, each of the side plates 12 has a cutout (or a hole) 12*a* in the middle part. Pins 30 are implanted on the main body lower portion 10*b*, and the side plates 12 are held between the main body lower portion 10*b* and the main body upper portion 10*a* with the pins 30 inserted in the cutouts 12*a*.

6. Bottom Plate 13

When the bottom plate 13 comes in contact with a ground surface such as a floor, it causes a change of the behavior due to a change of the load applied thereto. A variety of bottom plates 13 with different uneven shapes of the bottom are prepared, and a suitable one can be selected to enjoy the change. The bottom plate 13 has a hole 13*a* in the center part thereof, and the bottom of the main body 10 is fitted in the hole 13*a* so that the bottom plate 13 is supported.

HOW TO PLAY

Figure 9:
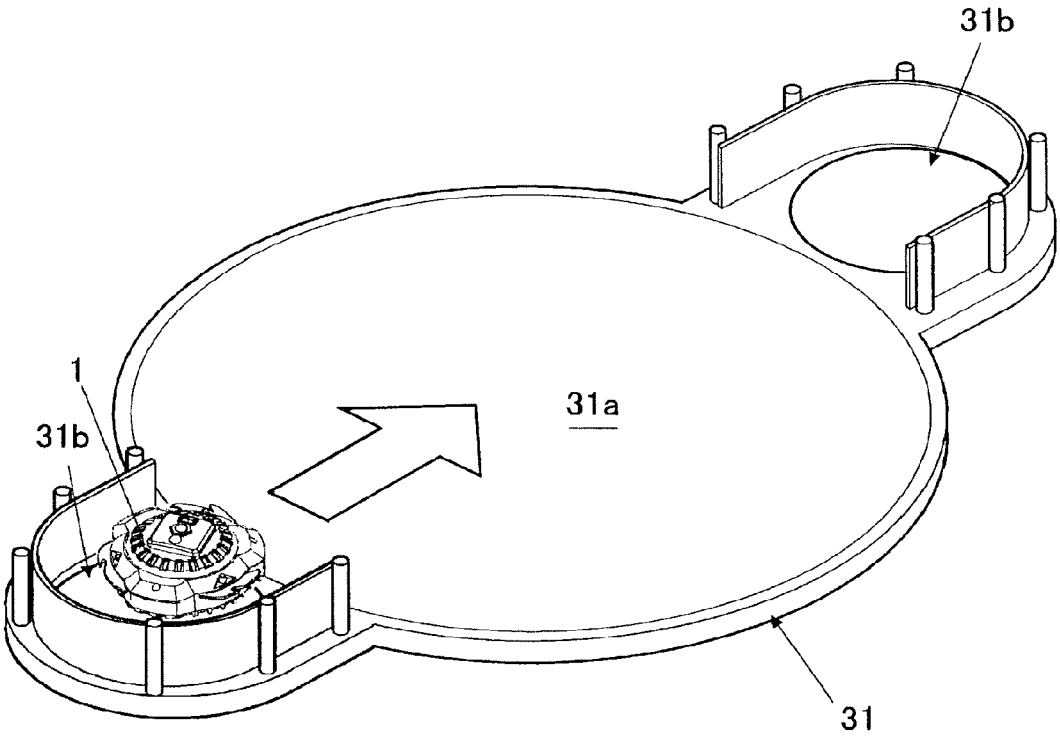
FIG. 9 is a perspective view of an example of a battle stadium for the toy top according to the embodiment.

As illustrated in FIG. 9, players can play with the toy tops 1 with the above-described configuration, for example, by making them fight each other in a battle stadium 31. The battle stadium 31 includes an approximately circular field 31*a* and U-shaped standby spaces 31*b* for housing the toy tops 1 at the respective ends of a diameter. The players place the respective toy tops 1 in the standby spaces 31*b* and start them. Then, the toy tops 1 move toward the center of the field 31*a*. By using the battle stadium 31, the players can play a game in which a player loses the game when his/her toy top 1 drops out of the field 31*a*.

While embodiments of the present invention are described above, the present invention is not limited to the above-described embodiments, and it should be understood that various changes can be made without changing the features of the present invention.

The present invention can be suitably applied to manufacturing of spinning top toys.

The invention claimed is:

1. A toy top, comprising:

a main body;

a battery; and a motor powered by the battery, wherein the main body, includes a first wheel and a second wheel that are disposed at a predetermined distance from each other along a wheel axis; and a power transmission mechanism that transmits power from the motor to rotate the first wheel in a first direction and to rotate the second wheel in a second direction that is different from the first direction, wherein the power transmission mechanism is configured such that, when the motor rotates in a forward direction, the first wheel rotates in the first direction and the second wheel rotates in the second direction, and when the motor rotates in a reverse direction, the first wheel rotates in the first direction and the second wheel is disconnected from the power transmission so that the second wheel is not driven by the motor.

2. The toy top according to claim 1, wherein the main body further comprises a lock mechanism that prevents rotation of the second wheel when the motor rotates in the reverse direction.

3. The toy top according to claim 2, wherein the power transmission mechanism comprises:

a sun gear coupled to the motor;

a first planetary gear and a second planetary gear that are engaged with the sun gear;

a first gear train coupled to the first wheel; and a second gear train coupled to the second wheel, wherein, when the motor rotates in the forward direction, the first planetary gear is coupled to the first wheel through an even or odd number of first power transmission gears in the first gear train, and the second planetary gear is coupled to the second wheel through a specified number of second power transmission gears in the second gear train, in which the specified number has a same parity as the number of the first power transmission gears, and wherein, when the motor rotates in the reverse direction, the second planetary gear is coupled to the first wheel through a specified number of third power transmission gears in the first gear train, and the first planetary gear is not engaged with any gear in the second gear train, in which the specified number has different parity from the number of the first power transmission gears.

4. The toy top according to claim 3, wherein the first planetary gear and the second planetary gear are supported by an arm that swings about an axis of the sun gear, and wherein the lock mechanism comprises a part to be locked that is integrally formed with one of the gears in the second gear train, and a locking part that is disposed in the arm and that locks the part to be locked when the motor rotates in the reverse direction so as to prevent rotation of the second wheel.

5. The toy top according to claim 1, wherein the main body comprises a removably mounted upper body portion selected from a plurality of upper body portions, each having a different weight.

6. The toy top according to claim 1, wherein the main body comprises a removably mounted side portion selected from a plurality of side portions, each having a different shape.

7. The toy top according to claim 1, wherein the main body comprises a removably mounted lower body portion selected from a plurality of lower body portions, each having a different shape.

8. A toy, comprising:

a playing field having separated standby portions on a periphery thereof;

at least two of the toy tops recited in claim 1, each being positioned in one of the standby portions.

9. A toy top, comprising:

a main body;

a battery; and a reversible motor powered by the battery, wherein the main body, includes— a first wheel and a second wheel that are disposed at a predetermined distance from each other along a wheel axis, and a power transmission mechanism that is capable of transmitting a power of the motor to rotate the first wheel in a first direction and to rotate the second wheel in a second direction that is different from the first direction, wherein the power transmission mechanism is configured such that when the motor rotates in a forward direction, the first wheel rotates in the first direction and the second wheel rotates in the second direction, and when the motor rotates in a reverse direction, the first wheel rotates in the first direction and the second wheel is disconnected from the power transmission, and wherein the main body further comprises a lock mechanism that prevents rotation of the second wheel when the motor rotates in the reverse direction.

10. The toy top according to claim 9, wherein the power transmission mechanism comprises:

a sun gear coupled to the motor;

a first planetary gear and a second planetary gear that are engaged with the sun gear;

a first gear train coupled to the first wheel; and a second gear train coupled to the second wheel, wherein, when the motor rotates in the forward direction, the first planetary gear is coupled to the first wheel through an even or odd number of first power transmission gears in the first gear train, and the second planetary gear is coupled to the second wheel through a specified number of second power transmission gears in the second gear train, in which the specified number has a same parity as the number of the first power transmission gears, and wherein, when the motor rotates in the reverse direction, the second planetary gear is coupled to the first wheel through a specified number of third power transmission gears in the first gear train, and the first planetary gear is not engaged with any gear in the second gear train, in which the specified number has different parity from the number of the first power transmission gears.

11. The toy top according to claim 10, wherein the first planetary gear and the second planetary gear are supported by an arm that swings about an axis of the sun gear, and wherein the lock mechanism comprises a part to be locked that is integrally formed with one of the gears in the second gear train, and a locking part that is disposed in the arm and that locks the part to be locked when the motor rotates in the reverse direction so as to lock rotation of the second wheel.

12. The toy top according to claim 9, wherein the main body comprises a removably mounted upper body portion selected from a plurality of upper body portions, each having a different weight.

13. The toy top according to claim 9, wherein the main body comprises a removably mounted side portion selected from a plurality of side portions, each having a different shape.

14. The toy top according to claim 9, wherein the main body comprises a removably mounted lower body portion selected from a plurality of lower body portions, each having a different shape.

15. A toy, comprising:

a playing field having separated standby portions on a periphery thereof;

at least two of the toy tops recited in claim 9, each being positioned in one of the standby portions.

* * * * *